US005558519A

United States Patent [19]

Sabowitz

[11] Patent Number: 5,558,519

[45] Date of Patent: Sep. 24, 1996

[54] METHOD FOR INSTRUCTION OF GOLF AND THE LIKE

[76] Inventor: Stuart Sabowitz, 293 Riverside Dr., New York, N.Y. 10025-5282

[21] Appl. No.: 282,626

[22] Filed: Jul. 29, 1994

[51] Int. Cl.[6] ..... A63B 69/36

[52] U.S. Cl. ..... 434/247; 434/252; 473/219

[58] Field of Search ..... 434/252, 247; 273/183.1

[56] References Cited

U.S. PATENT DOCUMENTS

| | | | |
|---|---|---|---|
| 3,772,800 | 11/1973 | Seze | 434/252 |
| 5,040,790 | 8/1991 | Anthes et al. | 434/252 |
| 5,082,281 | 1/1992 | Berghofer | 434/252 |

*Primary Examiner*—John S. Hilten

*Attorney, Agent, or Firm*—Schweitzer Cornman & Gross

[57] ABSTRACT

A golf training method in which the player is provided with a source of uniformly spaced-apart beat signals which are discernable by the golfer, either visually or audibly, or both. The golfer is guided to perform the backswing and foreswing portions of the golf stroke, from the moment of take-away to the moment of ball impact at the end of the foreswing, in synchronization with a predetermined number of beat signals, the first of which is synchronized with the moment of take-away and the last of which is synchronized with ball impact. The tempo of beat signals is adjustable to accommodate different golfers, and also to accommodate different swing tempos of the same golfer with different clubs and swing lengths. The source of beat signals advantageously is a small, pocket-size, battery operated electronic device adjustable to provide beat counts over a substantial range from, for example, 40 to 216 beats per minute.

5 Claims, 2 Drawing Sheets

FIG. 4
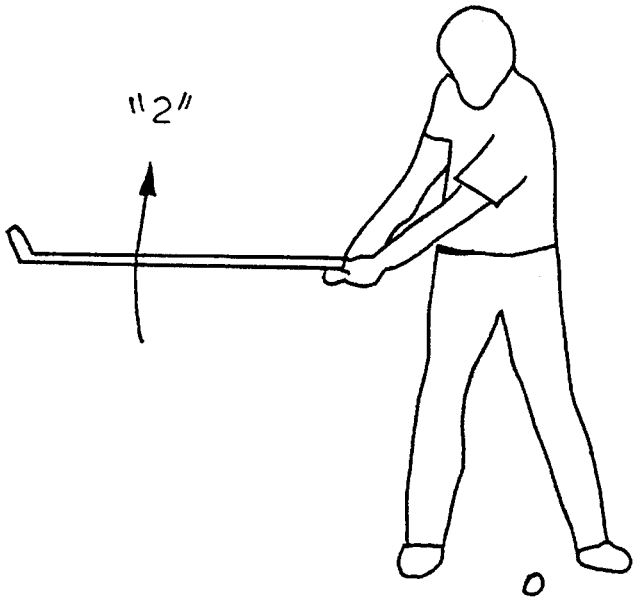
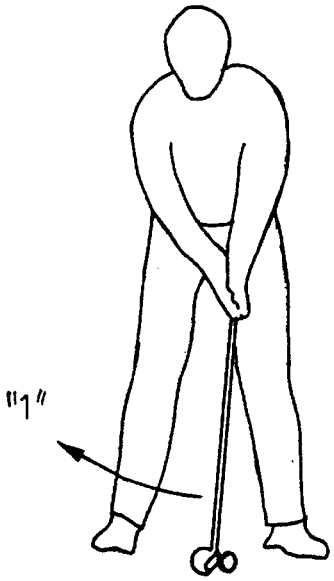
FIG. 3
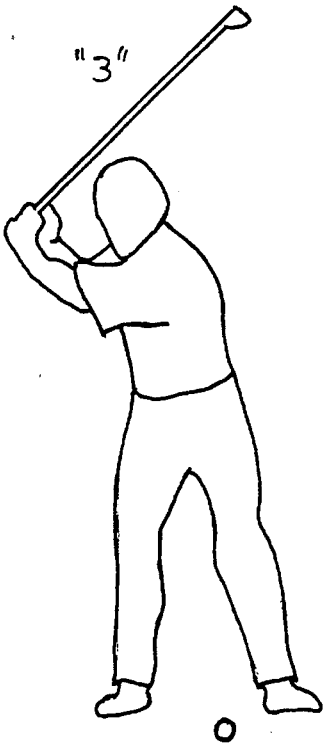
FIG. 5
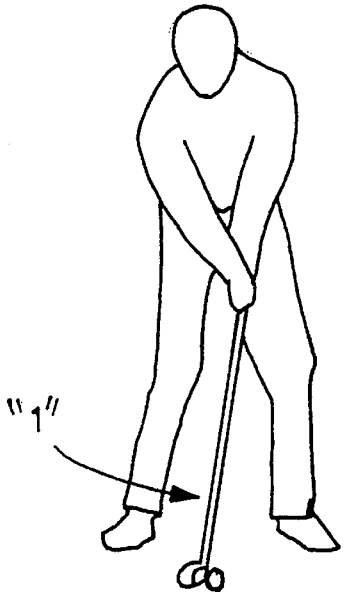
FIG. 6

METHOD FOR INSTRUCTION OF GOLF AND THE LIKE

BACKGROUND AND SUMMARY OF THE INVENTION

The present invention is directed particularly to the field of golf instruction, and more particularly to an improved system, including both a method of instruction and an apparatus for carrying out that method, for improving the timing and smoothness of a golfer's swing. The new method enables precise measurement of the tempo of a golf swing and repeated cueing of that tempo for training purposes.

Any discussion of the golf swing should attempt to isolate two key components of the swing—biomechanics and timing.

It may be argued that good timing results from the natural transfer or weight that occurs in a biomechanically well executed swing.

Conversely, it may also be argued that good timing may positively influence swing biomechanics. By providing a useful rhythmic device (the counting of a triple meter rhythm) within an adjustable temporal frame of reference that may be varied to suit any golfer's smooth and well-timed swing, in which the two crucial occurrences, or anchor points of such a swing—the take-away and ball contact—are provided for the golfer via the use of a device that produces a variable audible or visual output, the golfer may be aided in adjusting the biomechanics of the swing so as to allow for the smooth and comfortable completion of the swing within the time allotted between these two anchor points.

Several definitions, as related to the golf swing, will be helpful in clarifying the specific features and claims of this invention:

Timing—The golf swing is a complicated series of subtle movements that each must be accomplished in a set order and temporal relationship in order to reap the consistent power and accuracy that golfers strive to achieve. Timing refers to the speed, sequence and temporal relationship of these movements and may be considered to have two components—rhythm and tempo.

Rhythm—a musical term that refers to a specific meter or grouping of beats—in the case of this invention, triple meter or ¾ time, also called waltz rhythm—in which a measure or repeated rhythmic group consists of three beats, and is counted as "1,2,3,1,2,3 . . . " with continued emphasis on the "one" count of each series of three counts. This rhythm remains the same for all golf swings, baseball and other sport swings that have a backswing and foreswing component, and is thus a constant component to swing timing. The two most elementary and commonly used musical meters are duple meter (rock and roll, marches ) and triple meter (waltzes, golf swings). Ancient Greek philosophers understood that ¾ or triple meter to be "sacred" and akin to the most graceful of human movements, the dance. ⁴⁄₄ time or duple meter is still regarded as "common" time to this day.

Tempo—the speed at which the rhythm, or meter is to be counted, i.e. the tempo of one golf swing or club will be faster than another, even though their rhythm is the same, if the speed of the "1,2,3,1,2,3" count is faster for one swing than another and thus the swing tempo is a variable component to swing timing. Tempo is measured in beats per minute. An example of an average professional golf tee shot swing might be 184 beats per minute, counted in triple meter or ¾ rhythm, with the take-away occurring precisely on the first beat of the first three beat series (a musical measure or "bar") and ball impact occurring precisely on the first beat of the second three beat series, as in "1,2,3,1" [2,3]".

The proper swing of a golf club requires a smooth, motion of the club, from the commencement of the backswing to the striking of the ball and the subsequent follow through. When a golfer lacks this proper smooth motion, accurate control of the swing of the club head becomes difficult, the golfer's shot making becomes erratic, and much of the energy of the swing is lost.

One well known professional golfer taught that the development of a smooth, well-timed swing could be accomplished by conceptualizing performing the golf swing to a triple metered rhythm, described as a waltz rhythm. Such an approach is easily conceptualized, and not difficult to carry out in practice. However, the difficulty a player may experience in disciplining his swing stroke is not in finding the rhythm, but finding the precise optimum tempo at which the waltz rhythm should be counted off for any particular club. At the very least, there will be several different "perfect" tempos for the multiplicity of clubs and swings used by a golfer. For example, a driver may be expected to have a relatively slow tempo, whereas a wedge typically will be swung at a faster tempo. Each of the clubs or groups of clubs in between, from the driver to the wedge, typically be swung at a progressively faster tempo. Moreover, different types of swings using the same club, e.g., pitch, half-swing, chip, may also require different tempos.

Pursuant to the present invention, a new swing timing (rhythm and tempo) training system is provided, which includes the use of an adjustable beat timer that is visually and/or audible cognizable by the golfer during swing practice, enabling the golfer to develop and maintain a specific tempo of triple meter or ¾ waltz time rhythm (1,2,3,1,2,3) for each club or swing. To particular advantage, the beat timer is a small, portable, battery-driven electronic device, which is adjustable over a range of, for example, at least about 216 beats per minute to as low as about 40 beats per minute. The beats are produced either visually, for example by a flashing LED, or audible, by means of a built-in speaker or with an earplug for privacy.

In accordance with the system of the invention, a swing tempo program is followed, in which a golfer's backswing is comprised of three beats of the beat counter, counted as consecutive series of three beats to a series. The first "one" commences with the moment of take-away, and the first series of "one" "two" "three" carries the golfer through the backswing and into the foreswing. The foreswing, at the moment of impact with the ball, comprises the "one" count of the second series "one" "two" "three". Thus four beats are counted by the player as "one", "two", "three", "one". For each individual player, and for each individual club used by such player, the optimum beat rate will be different, and a swing timing "profile" for a player, covering the range of clubs and swing lengths to be used, should be empirically determined. Once the player's swing timing profile has been established, it can be maintained and reinforced in a desirable and advantageous manner following the system of the invention.

For a more complete understanding of the invention, and other features and advantages thereof, reference should be made to the following detailed description of a preferred embodiment of the invention and to the accompanying drawings.

DESCRIPTION OF THE DRAWINGS

FIGS. 3–6 are representations of a golfer's swing, showing approximate club positions at each beat count during a typical swing cycle.

DESCRIPTION OF PREFERRED EMBODIMENTS

The system of the invention is founded on the observation that an optimized golf swing has a distinct triple metered and constant rhythm, but with a variable tempo. For each of the clubs in a golfer's bag, the length of the club is different, resulting in a larger radius and thus in a longer path than the club head must travel, and the optimum arc of the backswing may also be different. Nevertheless, it has been observed that the overall rhythm of the swing remains the same, that is the backswing represents one full measure of ¾ or triple metered rhythm of the cycle along with the foreswing, up to the point of impact with the ball, which represents the down beat of a second musical measure or bar of ¾ time.

Pursuant to the invention, for each club used by the player, it is possible to empirically establish the desired tempo for that player and for that club. Desirably, the entire swing cycle from the moment of take-away to the moment of impact is divided into four counts or beats of a desired frequency. The first beat is at the moment of take-away to initiate the backswing. The second beat coincides with the backswing being approximately one-half completed, and the third beat coincides with the end of the backswing and part of the foreswing. The fourth beat, to be counted as the first beat of the second group of three, coincides with impact of the club head with the ball. When a player is hitting the ball smoothly with a given club, it is possible to repeat the swing on what is in essence a three-four beat, using a "one" "two" "three" "one" counting cycle. The first "one" is the start of the take-away, and the second "one" is the moment of impact of the club head with the ball. However, only beats one and four are precisely timed to two specific events, take-away and ball impact. Part of the method allows for the natural occurrence of movement during beats two and three of the cycle.

Figure 1:
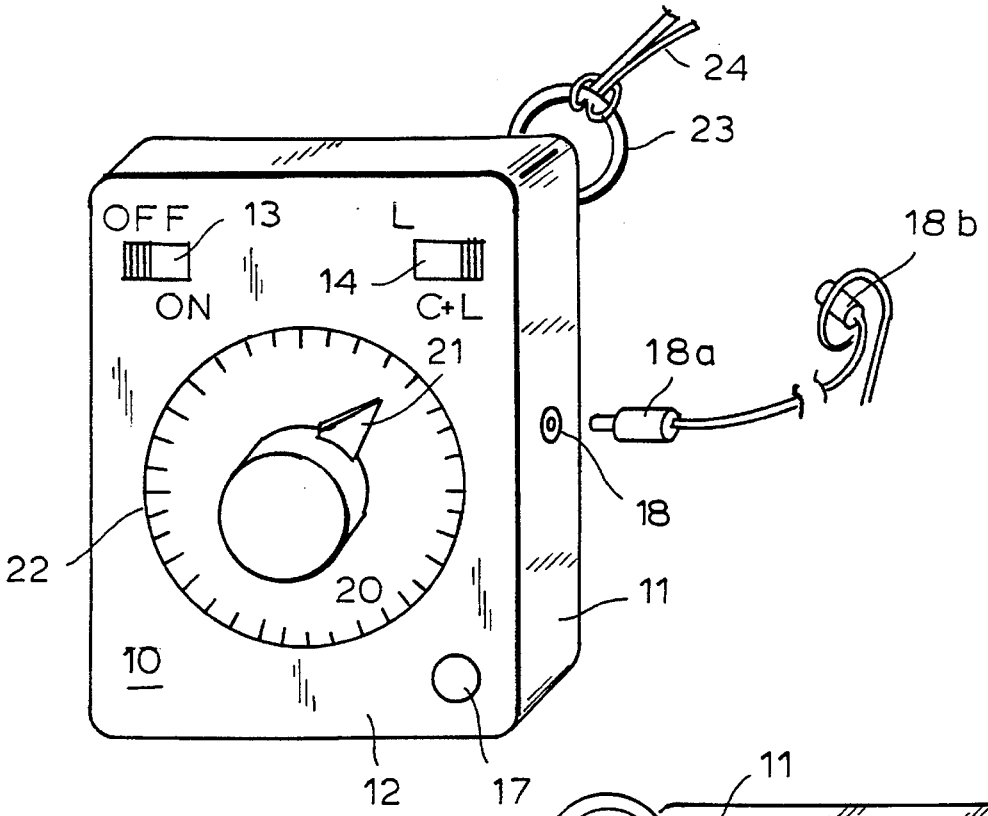
FIGS. 1 and 2 are front and back perspective views of a portable, pocket-size electronic beat indicator useful to advantage in carrying out the training procedures of the invention.
Figure 2:
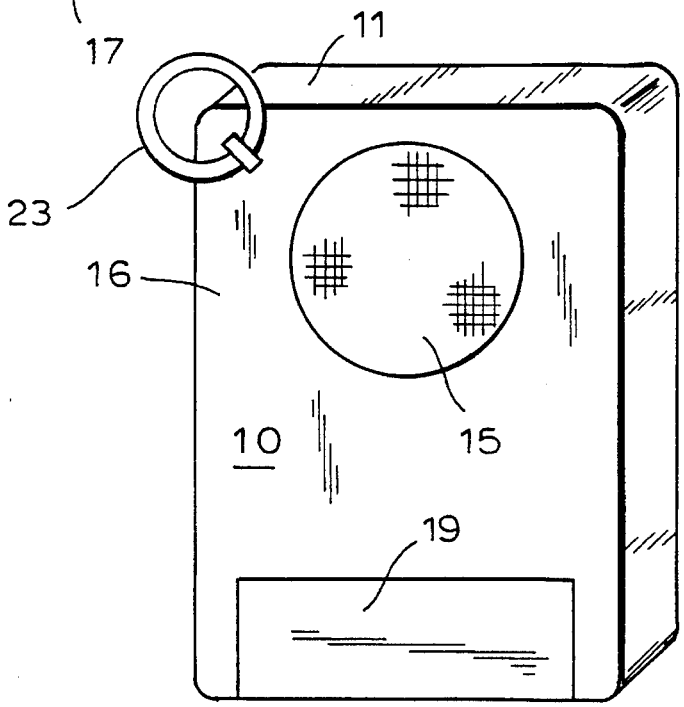

According to the invention, a golfer is assisted in establishing and maintaining a uniform rhythm for all swings and a specific tempo for a given club or swing, by means of an adjustable rate beat timer, which may be of a type illustrated in FIGS. 1 and 2. The beat timer, generally designated by the reference numeral 10, advantageously is a small, battery operated device which can easily fit into the golfer's pocket or be hung on the golfer's belt by means of a clip. The device advantageously includes a small plastic housing 11, for example about the size of a personal "beeper", provided on its front face 12 with an on-off switch 13 and a second switch 14 for selection of audible output from a speaker 15, which may be located at the back wall 16 of the housing. An LED or similar device 17 is exposed at the front wall 12 of the housing. In the illustrated device, a jack plug 18 is provided at one side for reception of an earplug jack **18*a*, enabling an audible output of the device to be heard only through the output of the earplug. Preferably, the audible sound is a distinct clicking sound, although for some purposes a "beep" sound may be appropriate and desirable. A suitable 9 volt or other battery may be loaded through an access plate 19** at the back of the device, for providing portable power.

In the illustrated form of the invention, the beat counter includes adjustment means, advantageously in the form of rotatable knob 20 having a pointer 21 and associated with a calibrated scale 22.

To advantage, the beat counting device may include internal electronic circuitry (not shown and itself forming no part of the invention) such as employed in conventional, commercially available electronic metronomes, for example. As such, the beat frequency range of the device may conveniently run from about 216 beats per minute, at the maximum, to about 40 beats per minute, at the minimum, it being understood that by minor redesign of the circuitry, the range of beat frequencies may be extended at either or both ends of the range, if deemed desirable. To particular advantage, the adjusting knob 20 provides for variable adjustment of frequencies over the entire range, at least in steps of several beats per second, so that the device may be adjustably set to generate a suitable incrementation of beats per minute over the entire range of the device.

To initiate a training program pursuant to the invention, the golfer selects a particular club and performs several practice swings while mentally going through a count of "one" "two" "three" for the backswing and initiation of the foreswing (see FIGS. 3–5) and, in the same rhythm, "one" upon ball impact (see FIG. 6). Once the player feels comfortable with the swing tempo, the beat counter can be turned on and adjusted with the knob until the beat, whether discerned by flashes of the LED element 17 or click-like sounds emanating from the speaker 15 or earplug **18*b***, approximates the tempo established during the practice swinging. The player may the modify this preliminary adjustment up or down as the swing becomes "grooved" at a comfortable tempo, in which the backswing is accomplished on three successive beats and ball impact occurs on the following beat. Preferably, the player should record the beat frequency for the selected club when the swing tempo appears to be optimum.

Once a tempo has been established by a player for one club or swing length, a complete swing timing profile may be established for each of the clubs or swings in the player's bag or repertoire, generally following the procedure outlined above for each club or swing length. It is generally known, however, that starting at the driver and ending at the wedge, the swing cycle, comprised of the backswing at three counts and the ball impact at a single count, becomes progressively shorter. For example, a typical weekend golfer may establish an optimum rhythm for a driver at 168 beats per minute. That same golfer might well find the optimum beat rate for a wedge to be, for example, approximately 184 beats per minute. Accordingly, after establishing an optimum tempo for one club, it becomes easier for the player to establish an optimum rate for other clubs in a progression.

When a player's swing timing profile has been ascertained for the player's entire range of clubs, the timing profile tends to remain more or less the same over a considerable period of time, although it may have to be adjusted up or down slightly over time as a player's abilities and playing habits are modified.

In any case where the stroke requires a particularly rapid beat, for example, when using a putter or any shot requiring a very short backswing where a player has a particularly rapid comfortable tempo, and the required "beat setting" would exceed the maximum for the instrument 10 (216 in the illustration), the beat count can be set at one-third the desired rate. For example, for a beat count of 240 per minute (exceeding the upper limit of the illustrated device) the beat rate may be set at one-third of that or 80. The player then mentally counts three beats or (in musical terms "triplets")

for each indicated beat of the counting device thus maintaining the triple metered rhythm pursuant to the method. Thus, the first output of the device would coincide with the start of the take-away, and the second output of the device would correspond to the impact of the club head with the ball.

In the various modes of operation of the device of FIGS. 1 and 2, where the switch 14 is set for quiet operation, the device may conveniently be placed near the ball position, for example, where the flashing of the LED 17 is evident to the player without actually taking his or her eye off the ball during the swing. The quiet mode may also be used to advantage by a coach to synchronize, i.e., measure a student's swing tempo without distracting the student. The on/off switch 13 also serves like a stop watch to cue the instant output of a beat, which is equally useful to the coach's need to synchronize the first beat of the "one" "two" "three" "one" series with the precise moment that the take-away begins.

Where an audible mode is employed, the device may be hung on a golf bag or placed in a pocket, for example. For hanging the device, a suitable key ring 23 and strap 24 may be employed. Where the audible mode is employed, privacy may be afforded by connecting the earplug **18*b* to the jack 18**.

The method of this invention provides for the first time an objective reference system that is universally applicable to all golf swings, that allows for precise measurement of, and thus adjustment to, the tempo of a golfer's swing. A refined application of the method, utilizing a timing device employing digital technology will enable a level of precision differentiation of hundredths or even thousandths of a beat per minute. For example, the tempo of a golfer's swing might be measured, in ¾ time, a 148.794 beats per minute, and the golfer might want to experiment with a swing tempo of 147.263 beats per minute as part of the process of discovering an optimal swing tempo. Thus the golfer now has obtained, with the method of the invention, not only the aforementioned, inherent benefit to be gained by conceptualizing the full golf swing from take-away to ball impact in triple metered rhythm, but in addition, has gained a heretofore unimagined level of sensitivity in objectively measuring and adjusting swing tempo. The two components of timing—rhythm and tempo—can now be completely controlled by the golfer, to great advantage.

Regardless of the effect of cueing a well-timed swing upon the biomechanics of the swing, the provision of such a temporal cue, in accordance with the invention, does offer unquestionable benefit. It can be clearly shown to regularize and "groove" the golfer's swing timing according to a universally applicable rhythm and an adjustable tempo chosen by the golfer. The method, for the first time, permits a golfer to adjust his or her swing timing with remarkable sensitivity and precision so as to produce the most consistently accurate and powerful result.

Sport psychologists indicate that the learning ability of an athlete is directly influenced by his or her ability to conceptualize the motions involved in a particular sport and to acquire skill through an ability to carry out such motions by a process of reaction and feedback and with positive reinforcement of correct results. Likewise, the athlete's ability to make very fine adjustments to a sports motion or behavior are affected by the sensitivity and precision with which those behaviors can be quantified or measured. The system of the invention provides a powerful medium for teaching and guiding a golfer or other athlete in the repetitive performance of a series of motions, optimized as to both rhythm and tempo.

Additionally, by focusing the athlete's attention on an optimum swing tempo and any deviations therefrom in the actual swing, the system of the invention can be employed as a valuable diagnostic tool, useful for both identifying and correcting problems with swing tempo.

Although the device and method of the invention are particularly useful in connection with the training of golfers, they also can be employed usefully in connection with other sports involving a rhythmic swing with a ball-striking implement. Two examples of such are baseball and tennis, where a batter or tennis player can benefit from the regular rhythm and repetitive, optimized tempo in the backswing/foreswing cycle provided by the procedures of the invention. Indeed, the procedure of the invention can be utilized to advantage in some other activities, such as the throwing of a baseball, for example.

The system of the invention can be usefully enhanced by incorporating in the device an electronic sensor operative to begin output automatically when the athlete begins the backswing.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A method of training a golfer to have a smoother, more constant golf swing with a golf club, which comprises (a) providing a source of uniformly spaced-apart beat signals discernible by the golfer, (b) guiding the golfer to perform the golf swing, from the moment of take-away to the end of the backswing and into the foreswing, in synchronism with first, second and third uniformly spaced beat signals derived from said source, with take-away being initiated at the first beat and the end of the backswing and initiation of foreswing occurring approximately at the time of said third beat, and (c) guiding the golfer to complete the foreswing portion of said golf stroke, with the moment of impact of club head with a ball occurring substantially in synchronism with a fourth uniformly spaced beat signal derived from said source.

2. A method according to claim 1, wherein (a) said beat signals are provided in the form of audible clicks and/or visible flashes.

3. A method according to claim 1, wherein (a) said uniformly spaced apart beat signals are adjustably variable, whereby the beat frequency is adjustable to accommodate a particular individual and, for said particular individual, to accommodate the use of a particular club or a particular swing length.

4. A method of training an athlete to have a smoother, more constant swing with a ball-striking implement, which comprises (a) providing a source of uniformly spaced-apart beat signals discernible by the athlete, (b) guiding the athlete to perform the swing, from the moment of initiating the backswing through the end of the backswing and into the foreswing, in synchronism with first, second and third uniformly spaced beat signals derived from said source, with take-away being initiated at the first beat and the end of the backswing and initiation of foreswing occurring approximately at the time of said third beat, and (c) guiding the athlete to complete the foreswing portion of said swing, with the moment of impact of the implement with a ball occurring substantially in synchronism with a fourth uniformly spaced beat signal derived from said source.

5. A method according to claim 4, wherein, (a) adjustable, battery-operated circuit means are provided for emitting a beat signal at a uniform but adjustable frequency, (b) first output means are provided for emitting an audible output of said beat signal, (c) second output means are provided for emitting a visual output of said beat signal, and (d) selectively activating either or both of said first and second output means.

* * * * *